US005983807A

United States Patent [19]

Tarnay et al.

[11] Patent Number: 5,983,807

[45] **Date of Patent: *Nov. 16, 1999**

[54] LIGHTWEIGHT PLASTIC FURNITURE

[75] Inventors: Matt Tarnay, Torrance, Calif.; Clifford Raab, Palm Harbor, Fla.

[73] Assignee: Virco Mfg. Corporation, Torrance, Calif.

[ * ] Notice: This patent is subject to a terminal disclaimer.

[21] Appl. No.: 09/092,455

[22] Filed: Jun. 5, 1998

[51] Int. Cl.[6] ..... A47B 3/00

[52] U.S. Cl. ..... 108/132; 108/131

[58] Field of Search ..... 108/131, 161, 108/132, 133, 129, 130; 248/188.6, 188.8, 188.91

[56] References Cited

U.S. PATENT DOCUMENTS

| | | | |
|---|---|---|---|
| 3,628,470 | 12/1971 | DeLuca | 108/131 |
| 4,951,576 | 8/1990 | Cobos et al. | 108/131 |
| 5,271,338 | 12/1993 | Bonham | 108/161 |
| 5,394,808 | 3/1995 | Dutro et al. | 108/129 |
| 5,694,865 | 12/1997 | Raab | 108/161 |
| 5,865,128 | 2/1999 | Tarney | 108/131 |

*Primary Examiner*—Peter M. Cuomo
*Assistant Examiner*—Gerald A. Anderson
*Attorney, Agent, or Firm*—James E. Brunton

[57] ABSTRACT

A lightweight, high strength folding table having a top assembly which includes a novel high strength, plastic reinforcing core. Pivotally connected to the top assembly are supporting legs. Interconnecting the supporting legs with the top assembly are novel folding leg mechanisms which include top assembly engaging links and leg engaging links pivotally connected both to the top assembly engaging links and also to the supporting legs. A locking rod extends between the top assembly engaging links, the end portion of which is slidably received within a slot formed in each of the leg engaging links. When the rod resides within the locking portion of the slot, the top assembly engaging links and the leg engaging links are locked against relative pivotal movement. However, when the locking rod is lifted slightly, the rod ends move into the channel portion of the slot permitting free pivotal movement of the cooperating links.

12 Claims, 11 Drawing Sheets

FIG. 1
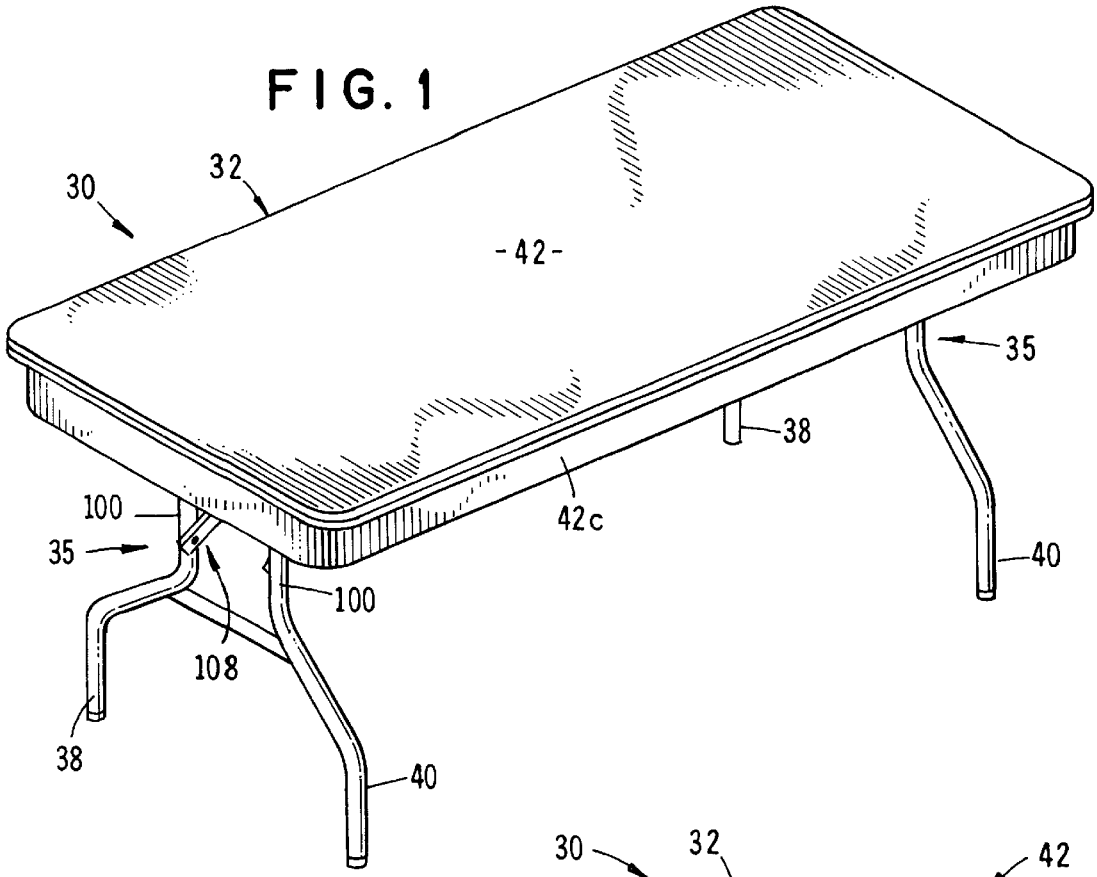
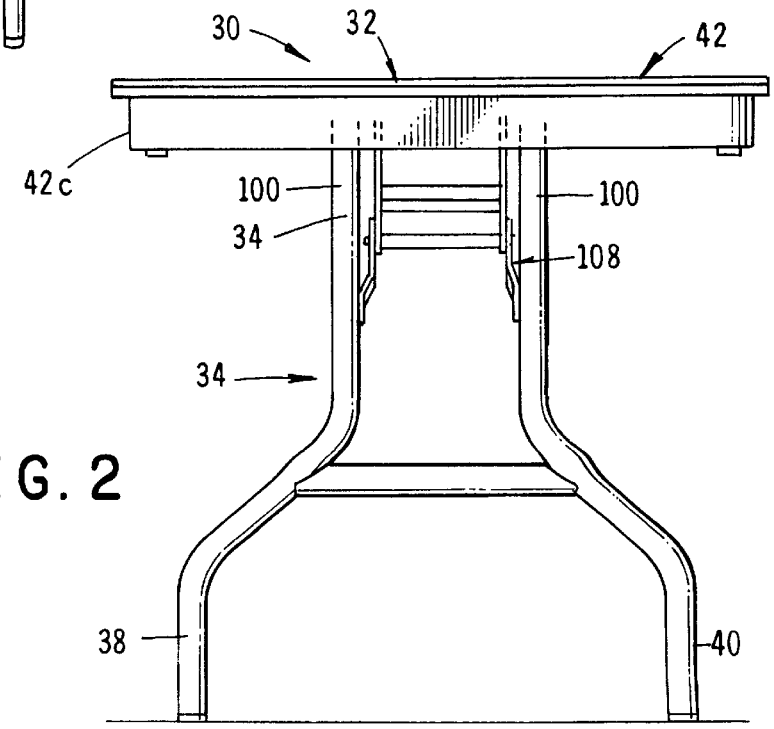
FIG. 2

42c
32
30
94
64
96
94a
98a
74a
38
98
100
108
114
110
74a
-74-
94
112
94a
110
14
100
116
136
14
34
40
74a
98a
94a
94
96

42c
62
50
42a
42
42b
54b
54c
104
84
54c
44
54
84a
54a
54a
77
32
90
55
64
74
66
77a
74a
72
70

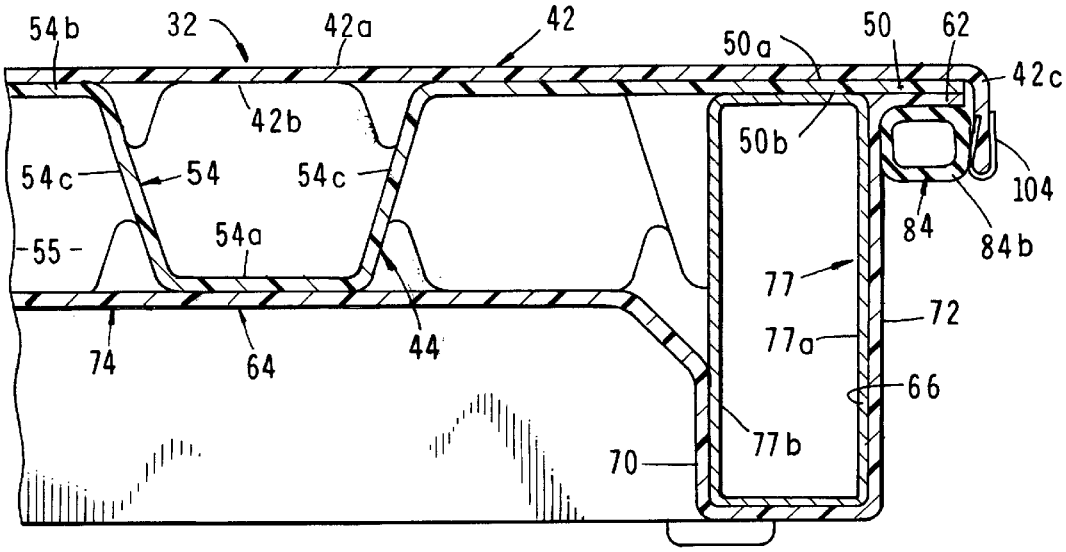
FIG. 8
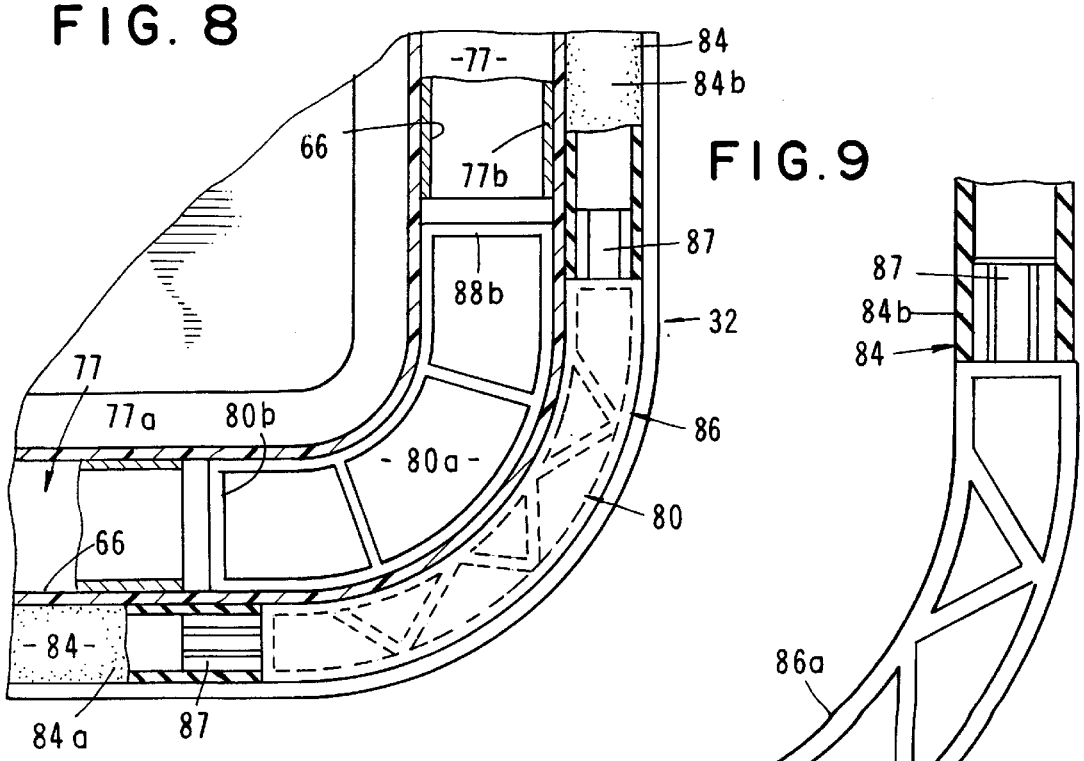
FIG. 9
FIG. 10

LIGHTWEIGHT PLASTIC FURNITURE

BACKGROUND OF THE INVENTION

1. Field of the Invention

The present invention relates generally to furniture. More particularly, the invention concerns an improved lightweight plastic folding table having a novel, structurally reinforced top and a unique folding leg mechanism.

2. Discussion of the Invention

Lightweight folding tables which exhibit superior structural characteristics and easy foldability are in wide demand for many industrial and institutional applications. Entities having great need for such tables include schools, convention centers, hotels, factories, business offices and various governmental entities. Particularly in demand are lightweight tables which are easily foldable for ready portable and storability when not in use.

While many types of lightweight tables been suggested in the past, a typical drawback of such tables is a lack of structural integrity which tends to contribute to limited useful life and to frequent structural failures. As a general rule, when the prior art furniture designers have attempted to correct the structural deficiencies in the prior art designs, the tables becomes excessively heavy and unduly bulky. As will be discussed in greater detail in the paragraphs that follow, the thrust of the present invention is to provide an improved lightweight, readily foldable table which embodies a unique structural reinforcement core that provide superior structural integrity to the furniture without unduly increasing its weight or bulkiness.

Exemplary of typical prior art plastic folding tables are those described in U.S. Pat. No. 4,951,576 issued to Cobos et al. The Cobos et al tables include upper and lower plastic table top halves and a framework grid, preferably made of wood, sandwiched therebetween. Another example of a prior art folding table is that described in U.S. Pat. No. 5,394,808 issued to Dutro et al. This table has a unitary table top formed of molded plastic preferably having an outer shell of non-cellular plastic with a filling of lightweight hardened foam. Other examples of prior art table constructions can be found in U.S. Pat. No. 5,271,338 issued to Bonham and in U.S. Pat. No. 3,628,470 issued to DeLucas. French Patent No. 1371706 issued to Evans shows a reinforcement member having a multiplicity of upstanding protuberances. However, the balance of the Evans structure is totally dissimilar to that of the present invention.

Because of the general similarities between the table of the present application and the table described in U.S. Pat. No. 5,694,865, which has been assigned to the assignee of the present inventors, is hereby incorporated by reference as though fully set forth herein.

SUMMARY OF THE INVENTION

An object of the present invention is to provide an improved, lightweight folding table which is strong, is highly reliable in use and has a long useful life.

Another object of the invention is to provide a lightweight, high-strength foldable table of the character described which is provided with a highly novel folding leg mechanism that is easy to use and is highly reliable.

Another object of the invention is to provide an improved folding table in which the top is constructed from readily available moldable plastic materials and can be efficiently and inexpensively manufactured in high volume.

Another object of the invention is to provide a folding table of the character described in the preceding paragraphs in which the folding leg mechanism is of simple design but yet provides positive support to the legs when they are in an extended, top support position.

Another object of the invention is to provide an improved folding table of the aforementioned character in which the folding leg mechanism includes means for preventing accidental collapse of the legs when the legs are in an extended, platform supporting position.

Another object of the invention is to provide a folding table of the character described in the preceding paragraph in which the folding leg mechanism is uniquely designed to positively prevent binding of the cooperating leg linkages as the legs are moved toward their stowed configuration.

Another object of the invention is to provide a folding leg mechanism as described in the preceding paragraph which includes a locking member that automatically moves by force of gravity into a locking configuration as the legs which support the platform are moved toward their downward platform support position.

Another object of the invention is to provide a folding leg mechanism for use with the improved table top which includes a locking member that is moved by a spring member into a locking configuration as the folding legs are moved into their downward, platform support position.

Still another object of the invention is to provide a lightweight folding table of the class described in the preceding paragraphs which is highly attractive and economical to produce.

BRIEF DESCRIPTION OF THE DRAWINGS

FIG. 1 is a generally perspective view of one embodiment of the improved lightweight plastic table of the present invention.

FIG. 2 is an end view of the folding table construction shown in FIG. 1.

FIG. 8 is an enlarged, cross-sectional view taken along lines 8—8 of FIG. 6.

FIG. 9 is an enlarged, fragmentary plan view partly broken away to show internal construction of the portion of the table top identified in FIG. 6 by the numeral 9.

FIG. 10 is an enlarged, top plan view, partly in cross section of the outer corner member shown in FIG. 9.

DESCRIPTION OF THE INVENTION

Figure 3:
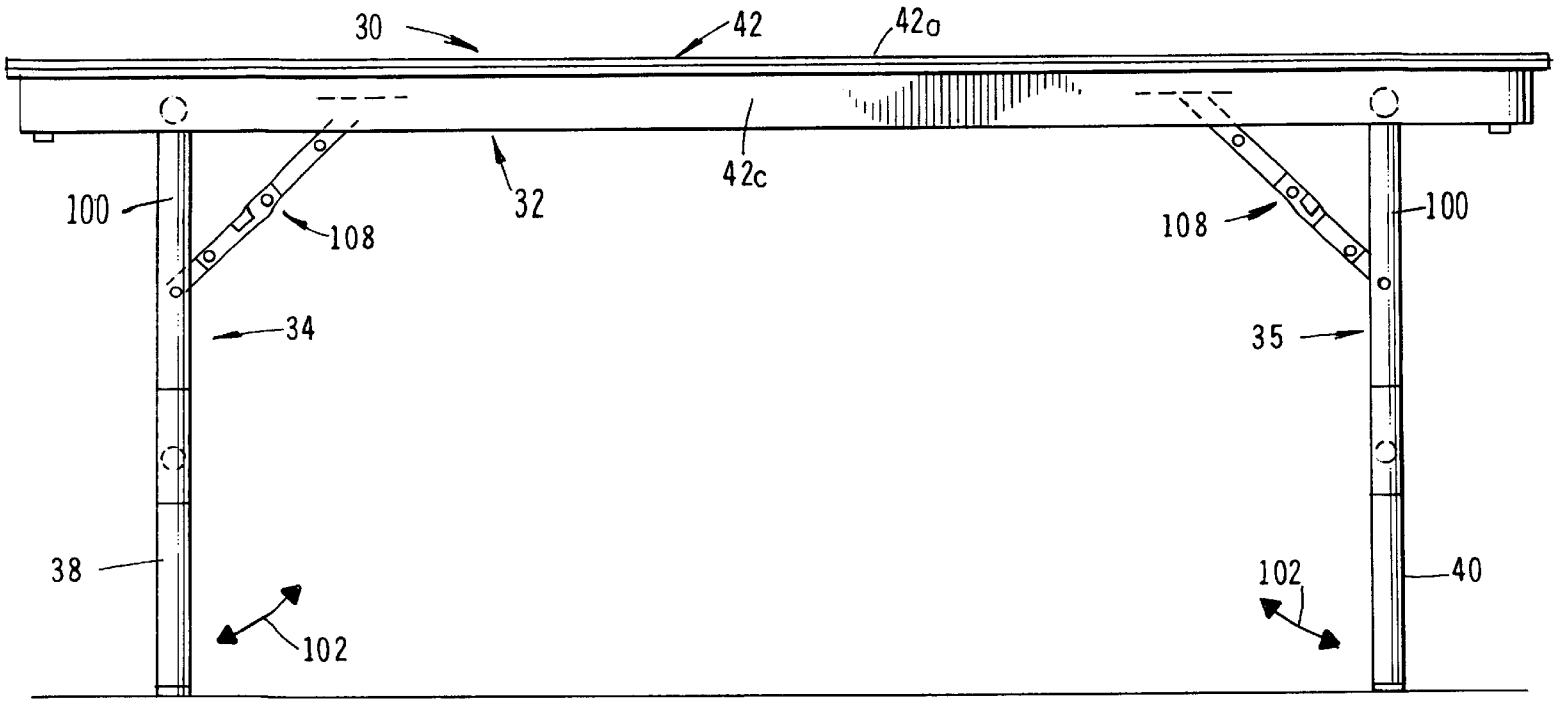
FIG. 3 is a side elevational view of the folding table shown in FIG. 1 with the legs folded in a stowed configuration.

Referring to the drawings and particularly to FIGS. 1, 2 and 3, one embodiment of the lightweight, high strength folding table of the present invention is there illustrated and generally designated by the numeral 30. The folding table of this form of the invention is similar in some respects to the folding tables shown in incorporated-by-reference U.S. Pat. No. 5,694,865 and comprises a top assembly 32 and first and second folding leg assemblies 34 and 35, each of which comprises a pair of downwardly extending legs designated in FIG. 1 as 38 and 40.

One important feature of the present invention is the uniquely configured top assembly 32 which is used in the construction of table 30. Another important feature of the invention is the unique folding leg mechanism which is used to connect the folding legs to the top assembly. This feature will later be described in greater detail.

Support member 42 also includes a second, generally planar surface 42*b* (FIG. 7A) which is spaced apart from surface 42*a*. Additionally, the support member includes a peripheral side wall 42*c* which circumscribes first surface 42*a* and defines a downwardly depending, skirt-like portion of the character best seen in FIG. 3. Support member 42 can be constructed from a number of different types of moldable plastic materials such as polyethylene, styrene, polyproplylene and like materials. However, acrylonitrile butadiene styrene (ABS) is preferred.

Figure 7A:
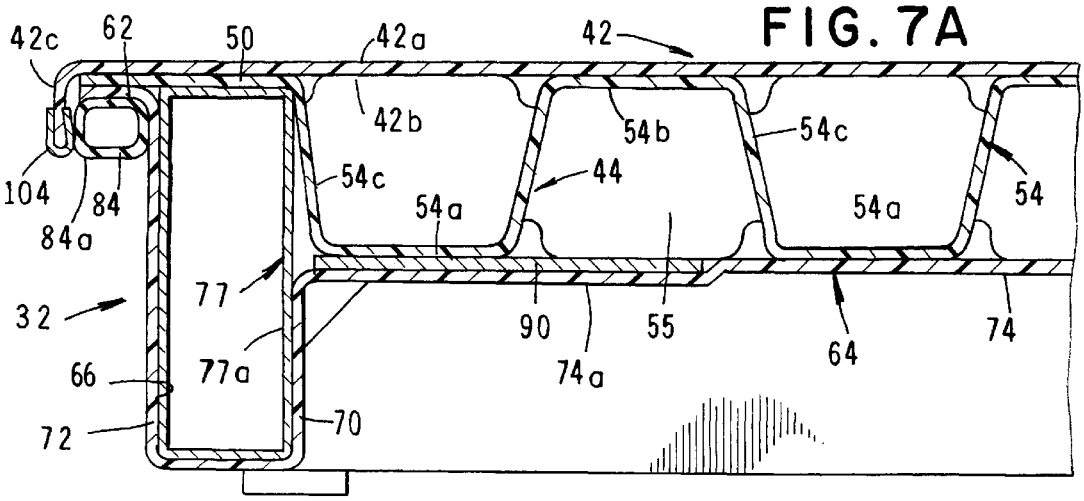
FIG. 7A and 7B together comprise an enlarged, cross-sectional view taken along lines 7—7 of FIG. 6.
Figure 7B:
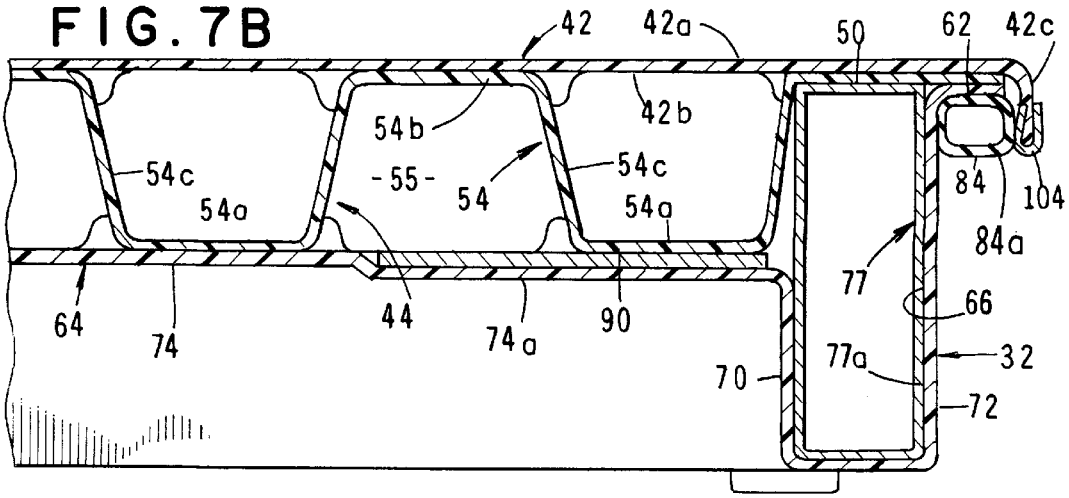

An important aspect of the top assembly of the present invention is the uniquely configured, relatively thin plastic reinforcement panel 44. As illustrated in FIGS. 7A and 7B reinforcement panel 44 is interconnected with support member 42 and functions in a novel manner to provide substantial structural support to member 42 so that the work surface 42*a* can withstand substantial vertical loading. Panel 44 can be of various configurations and can also be constructed from a number of moldable plastic materials of the character described in the preceding paragraph, but once again ABS is preferred. Depending upon the material selected, panel 44 can be vacuum formed, injection molded, or molded in a number of other ways well known to those skilled in the art.

Figure 11:
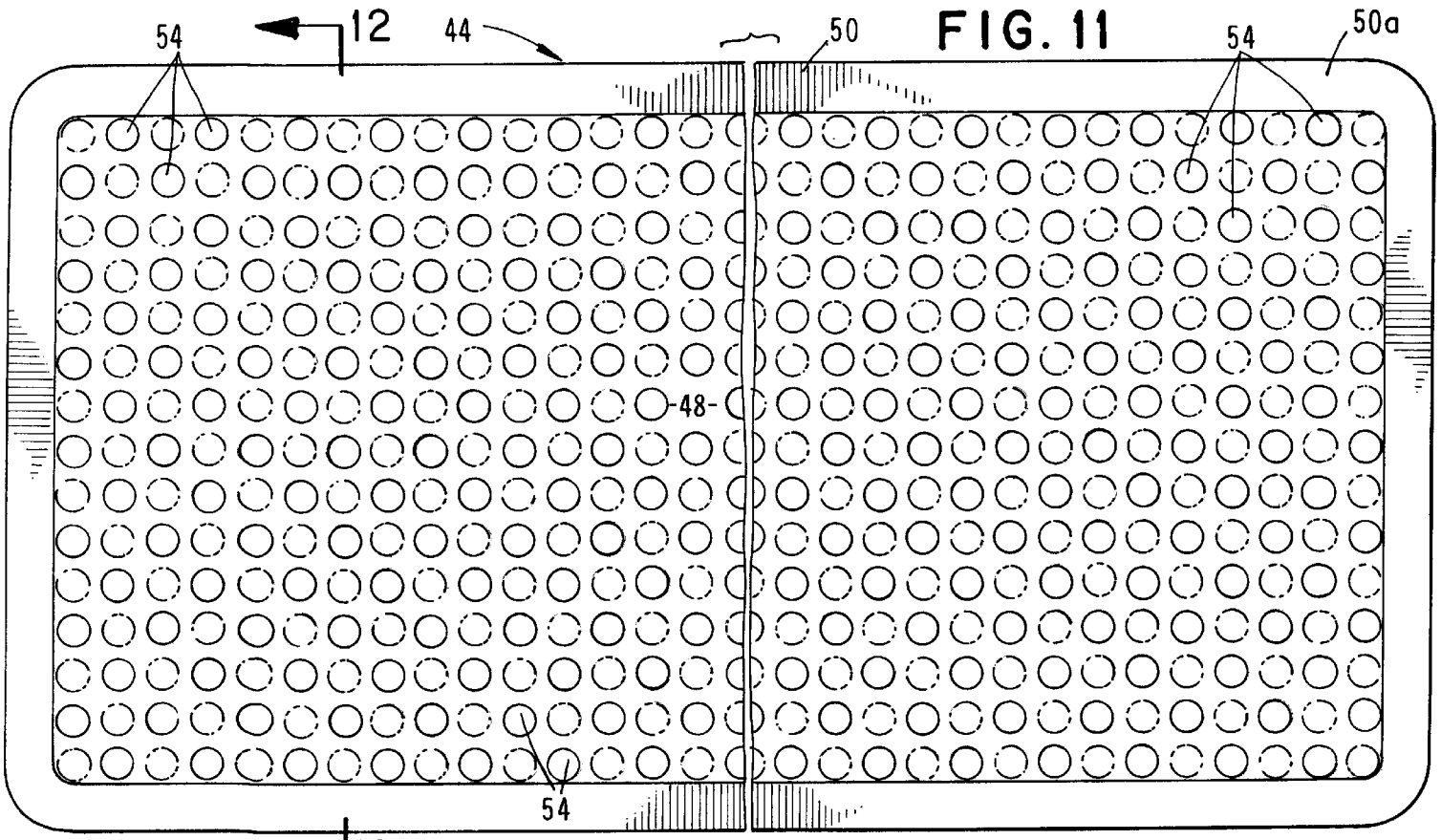
FIG. 11 is a top plan view of the reinforcing core of the table top construction shown in FIG. 1.
Figure 12:
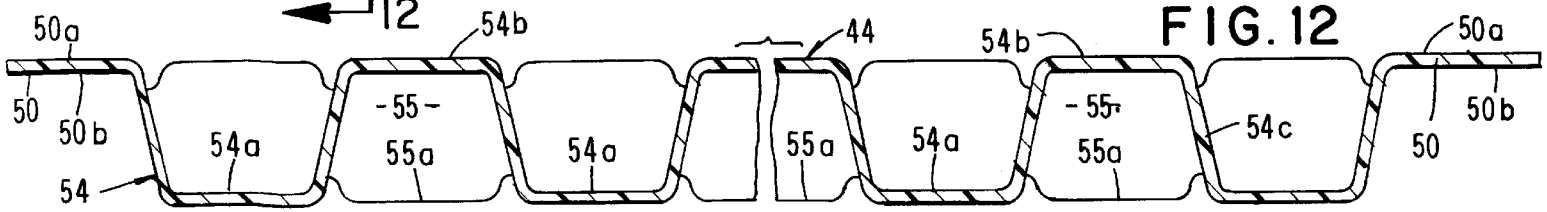
FIG. 12 is an enlarged, cross-sectional view taken along lines 12—12 of FIG. 11.

Referring particularly to FIGS. 11 and 12, the novel reinforcement panel 44 can be seen to includes a central portion 48 and a peripheral portion 50 which circumscribes central portion 48. The central portion is uniquely formed to provide a multiplicity of spaced-apart, specially configured, upstanding protuberances 54. As shown in FIG. 12, each protuberance comprises a base portion 54*a*, a vertically spaced-apart, generally circular-shaped closure wall 54*b*, and a tapered connecting wall 54*c* which interconnects base portion 54*a* and closure wall 54*b*. While protuberances 54 are shown in the drawings as being generally frustoconical in shape, the protuberances can be formed in a wide variety of shapes. As shown in FIG. 12, a multiplicity of cavities 55 are provided intermediate protuberances 54. Cavities 55 are also generally frustoconical in shape and terminate in base closure walls 55*a*.

The peripheral portion 50 of the reinforcement panel or core 44 comprises a circumscribing flange-like portion which defines generally planar upper and lower surfaces 50*a* and 50*b* (FIG. 12). As best seen in FIGS. 7A and 7B, flange-like portion 50 overlays and is connected to a mating flange-like portion 62 formed on a bottom enclosure panel 64, which also forms a part of the top assembly of the invention. As shown in FIGS. 7A and 7B, a channel 66 is formed in the peripheral portion of enclosure panel 64 and is defined by inner and outer, spaced-apart, circumscribing walls 70 and 72, which also form a part of the peripheral portion of the enclosure panel. A generally planar central wall 74 spans inner wall 70 and is preferably integrally formed therewith. Central wall 74 is provided with a plurality of indentations 74*a* (FIG. 6), the purpose of which will presently be described.

Figure 4:
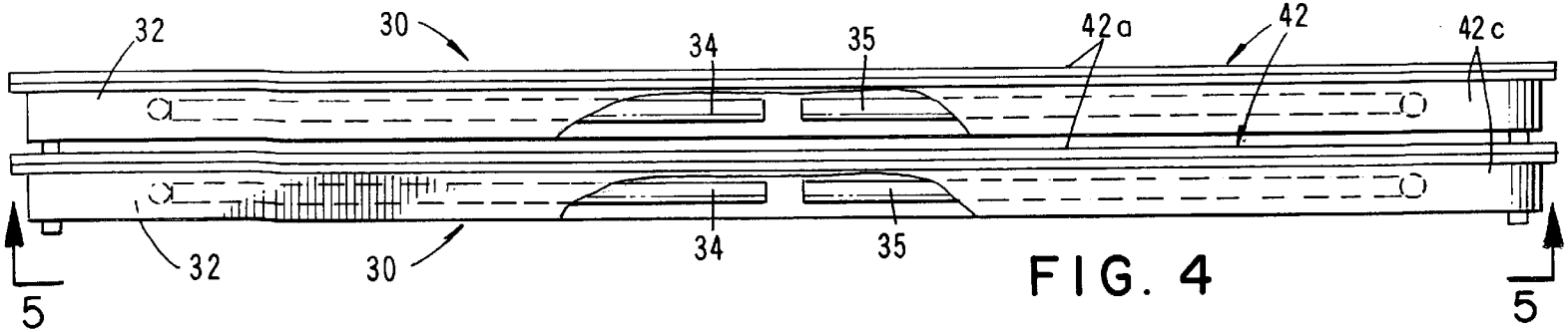
FIG. 4 is a side elevational view of a pair of folding tables of the character shown in FIG. 1 which are depicted in a stacked configuration.
Figure 6:
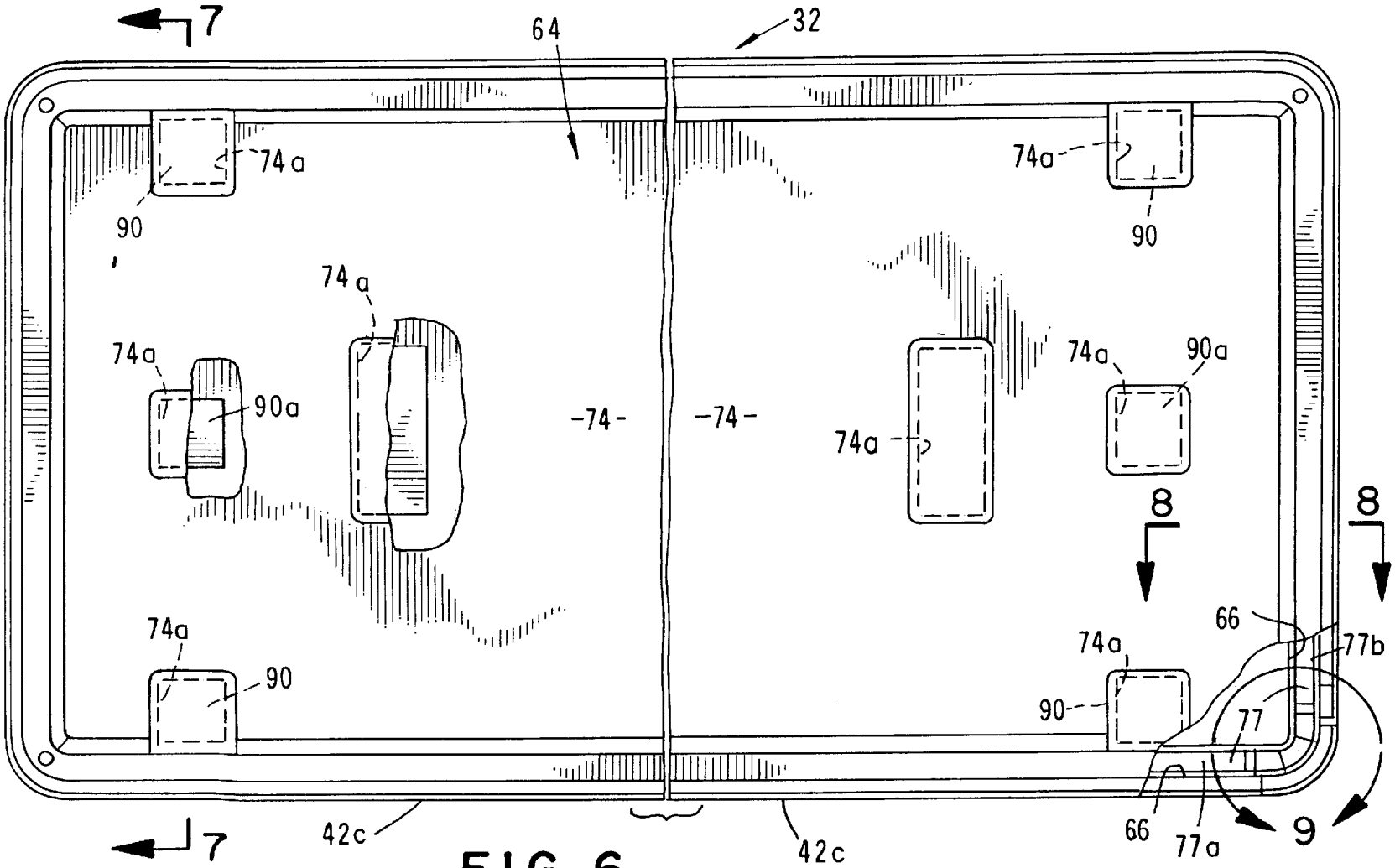
FIG. 6 is an enlarged, foreshortened bottom plan view of one of the table tops of the embodiment of the invention shown in FIG. 1.

Receivable within channel 66 of enclosure panel 64 is a novel, strategically shaped reinforcement frame 77 (FIGS. 3, 4, and 6). As best seen in FIGS. 6, 8 and 9, reinforcement frame 77 includes a pair of spaced-apart, longitudinally extending structural beams or extrusions 77*a* and a pair of spaced-apart, transversely extending beams or extrusions 77*b*. As illustrated in FIG. 9, beams 77*a* and 77*b* are interconnected by four uniquely configured corner assemblies 80, each of which includes a central, arcuate shaped, hollow portion 60*a* which is closed by end walls 80*b*. As indicated in FIG. 9, end walls 80*b* abut the longitudinally and transversely extending support beams when frame 77 is positioned within channel 66 of enclosure panel 64. Importantly, beams or extrusions 77*a* and 77*b* are generally rectangular in cross section and are preferably formed of a rigid, high strength plastic or metal material as are the corner assemblies 80. As best seen in FIGS. 7A, 7B and 8, beams 77*a* preferably and 77*b* have a height substantially twice the height of protuberances 54 and function to provide substantial rigidity to top assembly 32. Reinforcement frame 77 can simply rest within channel 66 or, if desired, can be secured within the channel by any suitable means such as by adhesive bonding.

As illustrated in FIGS. 7A, 7B, 9, and 10, a novel edge reinforcing frame 84 is also receivable between peripheral flange 42*c* of cover 42 and wall 72 of enclosure panel 74 in the manner shown in the drawings. As best seen in FIGS. 6, 9, and 10, frame 84 includes a pair of longitudinally extending tubular members 84*a* and a pair of transversely extending tubular members 84*b*. Members 84*a* and 84*b* are interconnected by novel corner members 86. As best seen in FIG. 10, each corner member 86 includes an arcuate central portion 86*a* having outwardly extending, finger-like projections 87 which are closely receivable within tubular members 84*a* and 84*b* when the members are assembled in the manner shown in FIG. 10. Reinforcing frame 84 can be constructed of a variety of moldable plastic materials such as polyvinyl chloride, polyethlysne, and butyrate and functions to effectively support and attractively trim out the edge portions of the platform assembly in the manner best seen in FIGS. 7A and 7B.

Another important feature of the improved table of the present form of the invention comprises anchor means for use in securely interconnecting leg assemblies 34 and 35 to the support platform or table top. These anchor means are here provided in the form of a plurality of anchor plates 90 to which the folding legs of the table can be securely interconnected. Anchor plates 90 are positioned within the previously identified, spaced-apart anchor plate receiving indentations 74*a* which are formed in the central portion of closure panel 84. More particularly, a pair of anchor plates 90*a* are received within centrally disposed indentations 74*a* while the remaining anchor plates are received within the indentations located proximate the side portions of the enclosure panel 74.

Figure 5A:
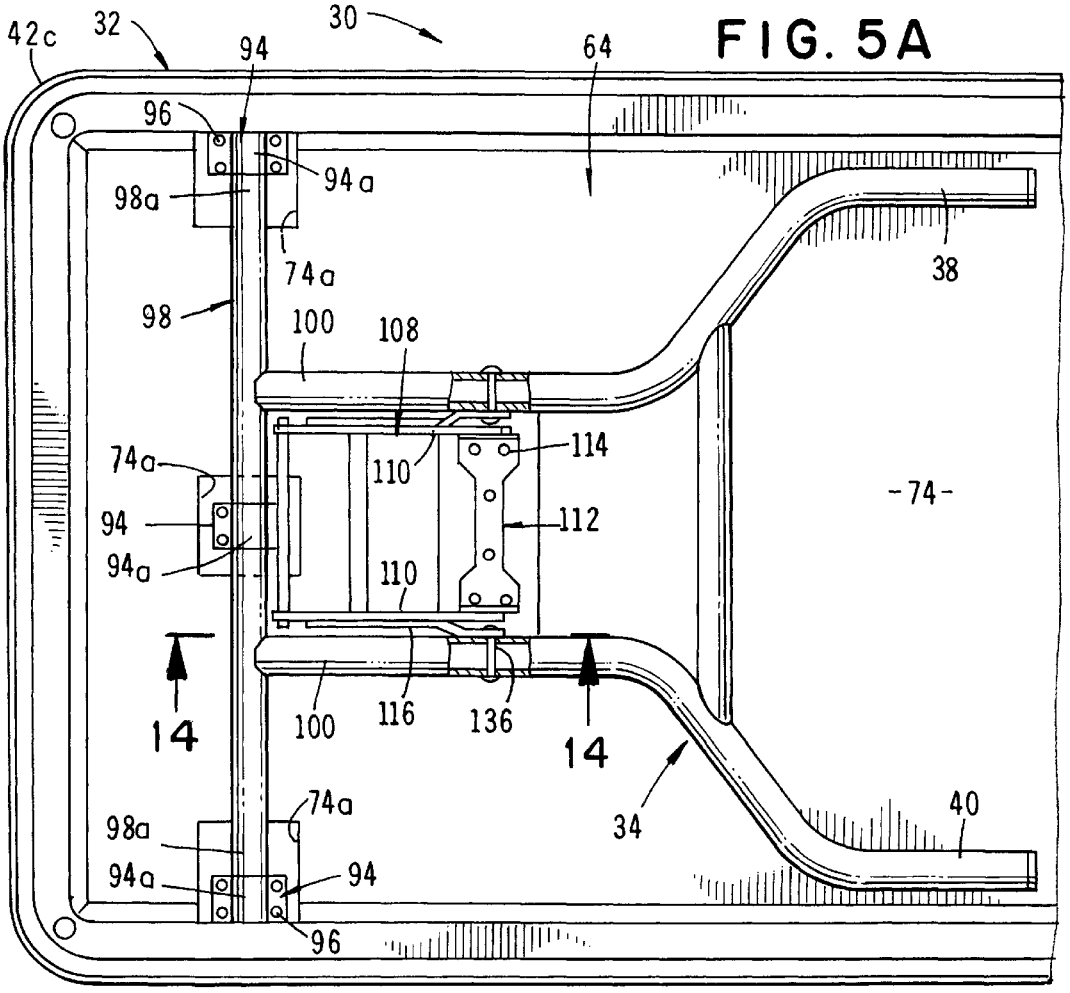
FIG. 5A and 5B together comprise an enlarged bottom plan view of one of the folding tables of the invention illustrating the legs thereof in a folded configuration.
Figure 5B:
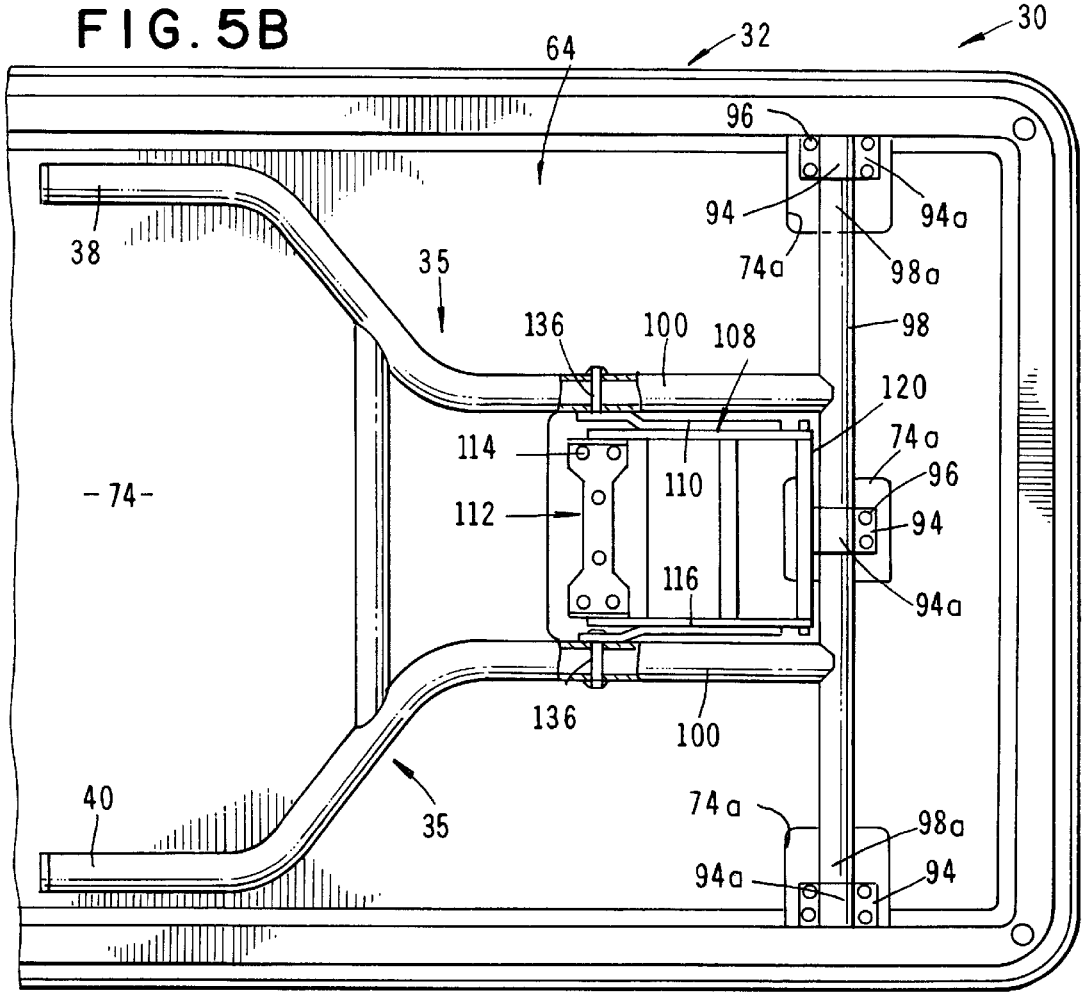
Figures 15, 16:
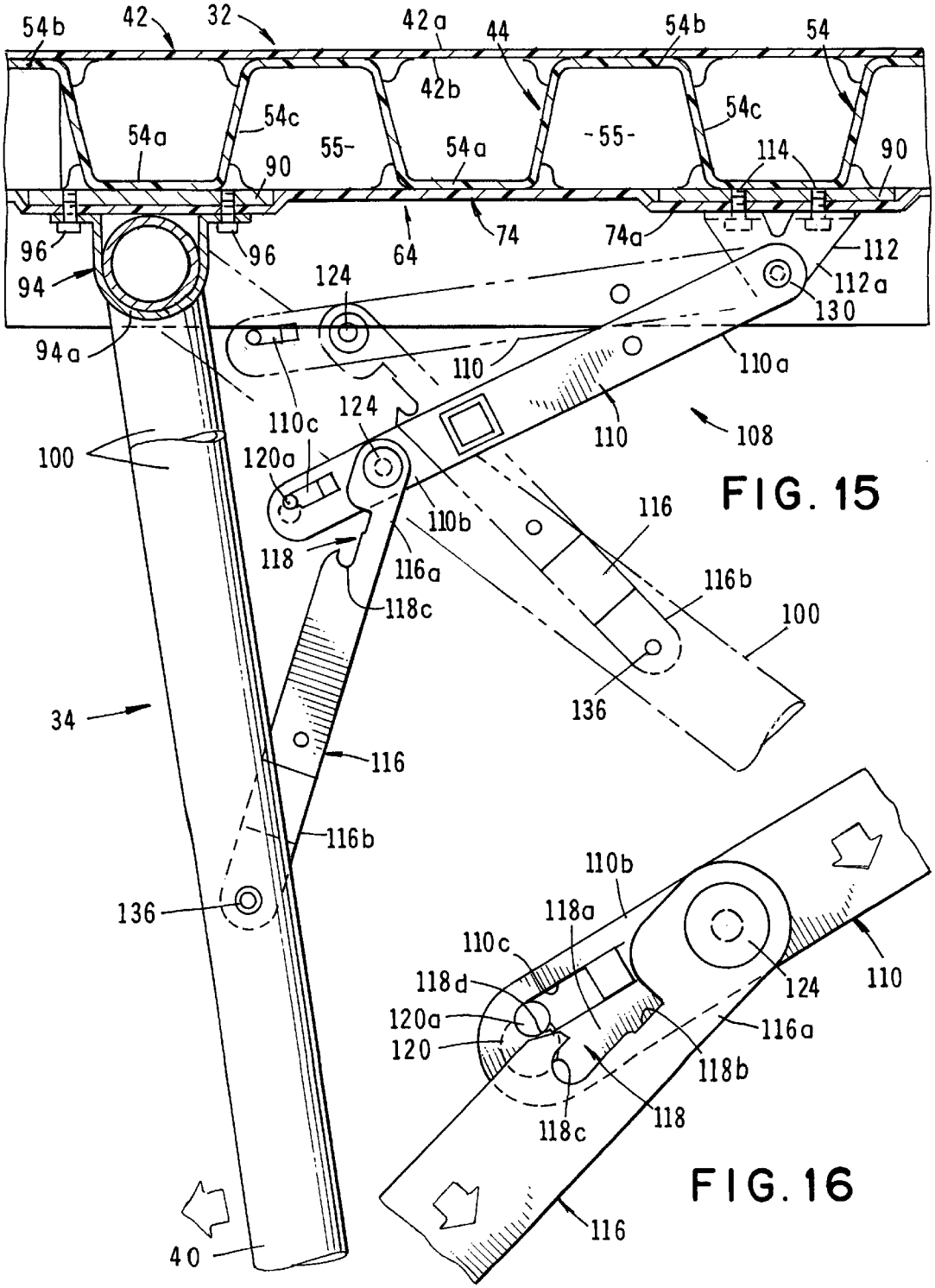
FIG. 15 is an enlarged, side-elevational view, partly in cross section, of the folding leg mechanism of the invention shown interconnected with the table top and with one set of legs, the folding mechanism being shown in a partially folded configuration.
FIG. 16 is an enlarged, fragmentary, side-elevational view of the locking portion of the folding leg mechanism shown in a position immediately prior to the ends of the locking rod of the folding leg mechanism moving into a locking aperture formed in the leg engaging links of the mechanism.

To pivotally support leg assemblies 34 and 35 relative to the top assembly, novel leg support means are provided. These leg support means here comprise six transversely, spaced-apart bearing plates or generally U-shaped clamping elements 94 each of which includes a concave portion 94*a* that is disposed between spaced-apart, wing-like connector elements. The bearing plates are connected to enclosure panel 74 and to the anchor plates 90 in the manner depicted in FIGS. 5A, 5B, 14 and 15 by suitable connectors such as self-drilling and tapping threaded fasteners 96 which extend through wing-like portions, through the wall of enclosure panel 74 and into anchor plates 90 in the manner shown in FIG. 15. With this construction, the convex channels or central portions 94*a* of bearing plates 94 function as bearing means for rotatably supporting the extremities 98*a* of each of the horizontally extending, generally tubular shaped, axle-like members 98, which comprise a part of the leg assemblies 34 and 35 of the invention (FIGS. 5A and 5B). Also forming a part of each of the leg assemblies 34 and 35 are connector segments 100, the extremities of which are connected to axle-like members 98 as by welding. With the construction thus described, the two leg assemblies 34 and 35 can pivot relative to top assembly 32 in the manner indicated by the arrows 102 of FIG. 1 of the drawings.

In interconnecting the leg assemblies with the top assembly, the bearing plates 94 are first placed over the ends and central portions of the tubular members or axles 98 of the leg assemblies. This done, the bearing plates are then connected to the enclosure panel and to the anchor plates 90 using the previously identified threaded fasteners 96. Next, in a manner presently to be described, the novel folding leg mechanisms of the invention are installed.

To complete the assembly of the foldable table, a generally U-shaped plastic trim strip 104 is slipped over the lower edge of flange 42*c* of cover 42 in the manner shown in FIGS. 7A and 7B.

Referring now to FIGS. 13 through 21, one form of the previously mentioned folding leg mechanism of the present invention for use in foldably interconnecting leg assemblies 34 and 35 with the top assembly 32 is there illustrated and generally designated by the numeral 108. As best seen by referring particularly to FIG. 13, the folding leg mechanism here comprises first and second spaced-apart top links 110. Links 110 are of similar construction and each has a first end 110*a* and a second end 110*b*. Pivotally connected to links 110 proximate ends 110*a* thereof, is a securement means, shown here as a linkage plate 112 which linkage plate is interconnected with the lower surface of the table assembly in the manner shown in FIGS. 15 and 18*b* using suitable connectors, such as threaded connectors or screws 114.

Figure 13:
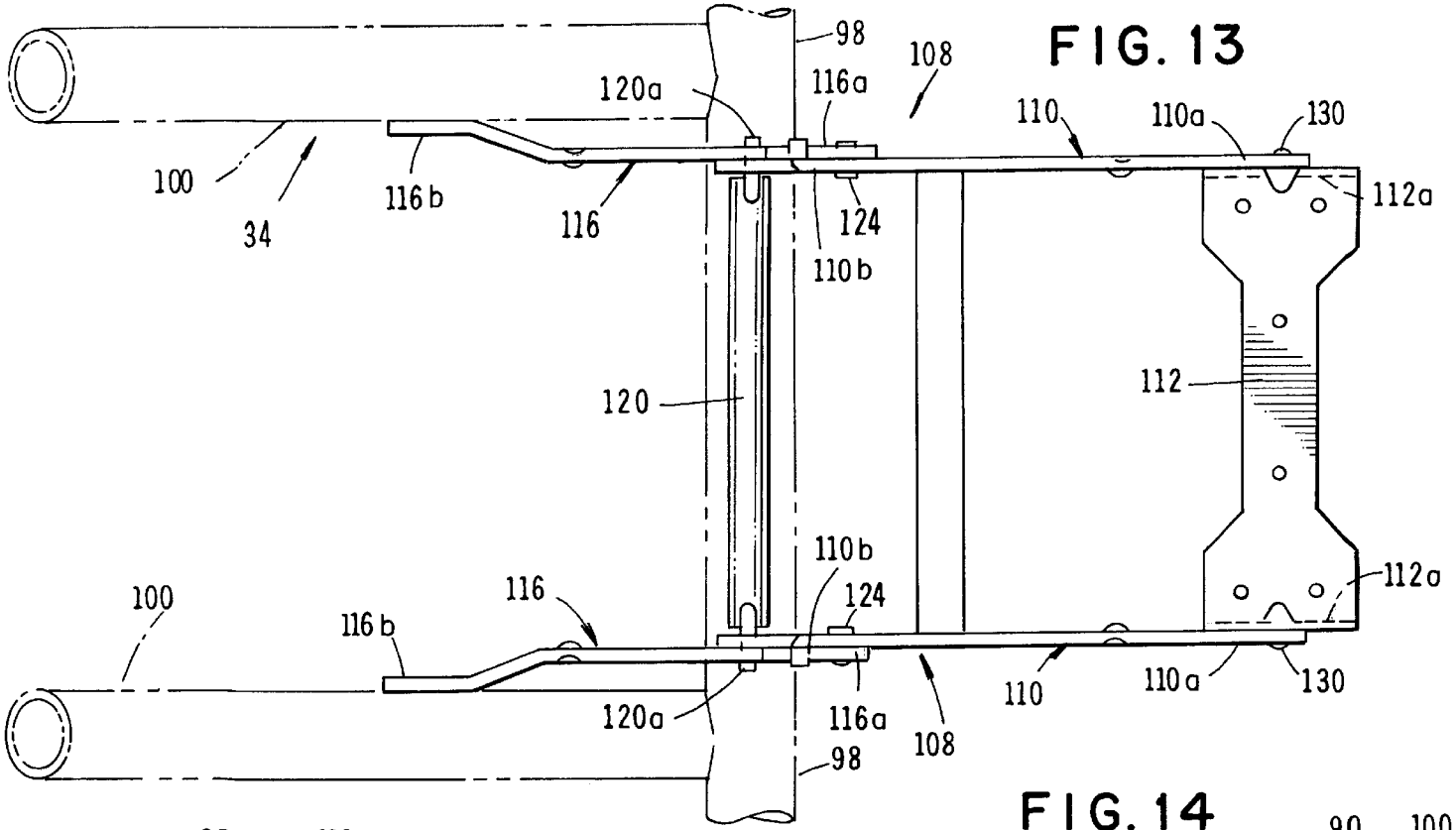
FIG. 13 is an enlarged plan view of one form of the folding leg mechanism of the improved folding table of the present invention.
Figure 14:
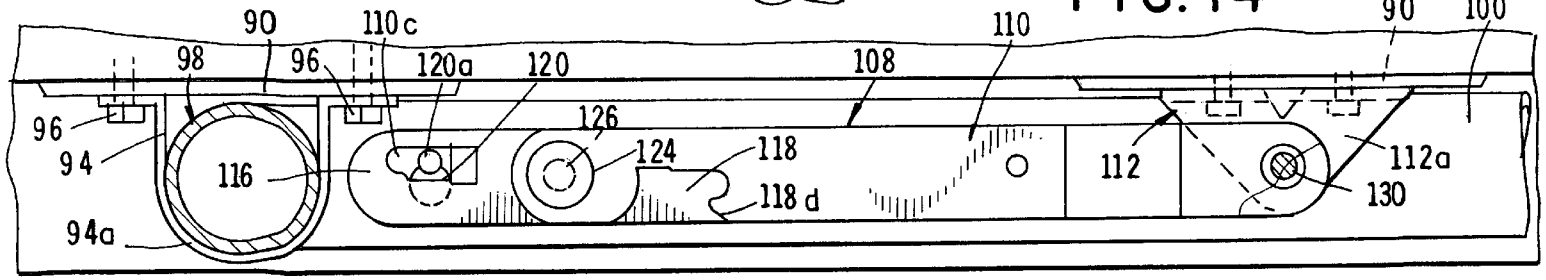
FIG. 14 is an enlarged, cross-sectional view taken along lines 14—14 of FIG. 5A.
Figures 20, 21:
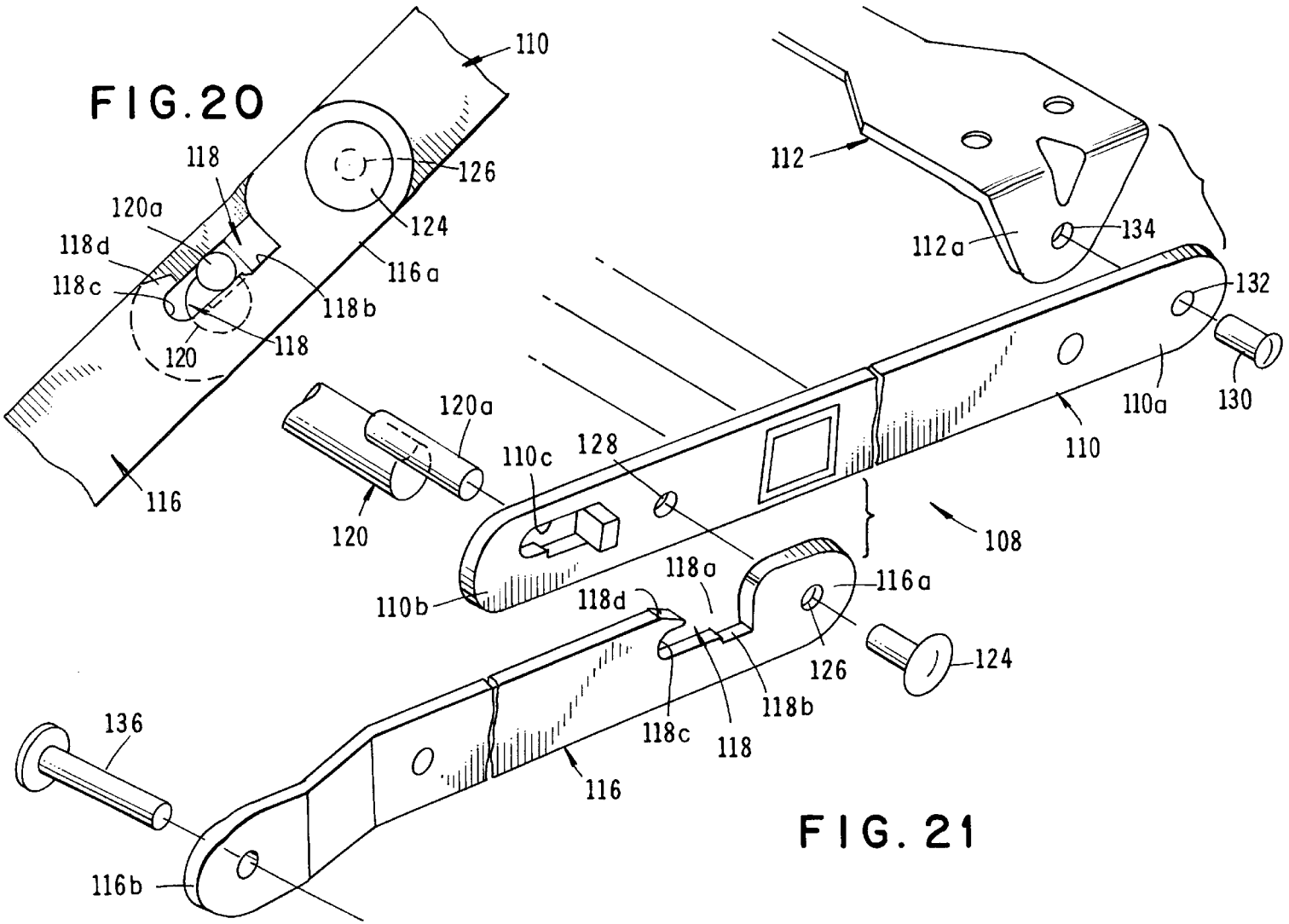
FIG. 20 is a fragmentary, side-elevational view similar to FIG. 19, but showing the locking rod portion of the folding leg mechanism being moved into a disengagement or release position.
FIG. 21 is a greatly enlarged, generally perspective, exploded view of one of the pair of cooperating linkages of the folding leg mechanism and a portion of the support platform engaging bracket of the mechanism.

Also forming a part of the folding leg mechanisms of the invention are first and second leg links 116. Leg links 116 are of similar construction and each includes first and second end portions 116*a* and 116*b* respectively (FIG. 13). As best seen by referring to FIGS. 15 and 16, each leg link 116 is provided, proximate end portion 116*a*, with a rod receiving slot 118. Rod receiving slots 118 are of a unique configuration and slidably receive the end portions 120*a* of a transversely extending locking rod 120 (FIG. 21). More particularly, each rod receiving slot 118 includes a channel-like portion 118*a* extending between first and second end portions, a shoulder portion 118*b* disposed proximate the second end portion, and an arcuate-shaped locking aperture portion 118*c* disposed proximate the first end portion. Also forming an important aspect of the rod receiving slots 118 is an angled ramp portion 118*d*. The manner of operation of the locking rod 120 will presently be described.

Links 116 are pivotally interconnected with links 110 by a pivot pin 124 which extends through an aperture 126 provided in end portion 116*a* of link 116 and through an aperture 128 provided in link 110 proximate end 110*b* thereof (FIGS. 21). Similarly, link 110 is interconnected with the securement means or plate 112 by a pivot pin 130 which is receivable through an aperture 132 provided in link 110 proximate end 110*a*. Pin 130 also extends through an aperture 134 provided in a downwardly extending leg portion 112*a* formed on plate 112. Each end 116*b* of each link 116 is pivotally connected to one of leg segments 100 by means of a locking pin 136. Locking pins 136 are receivable through apertures formed in segments 100 and in ends 116*b* of links 116 so as to pivotally connect links 116 to segments 100.

Figures 17, 18, 19:
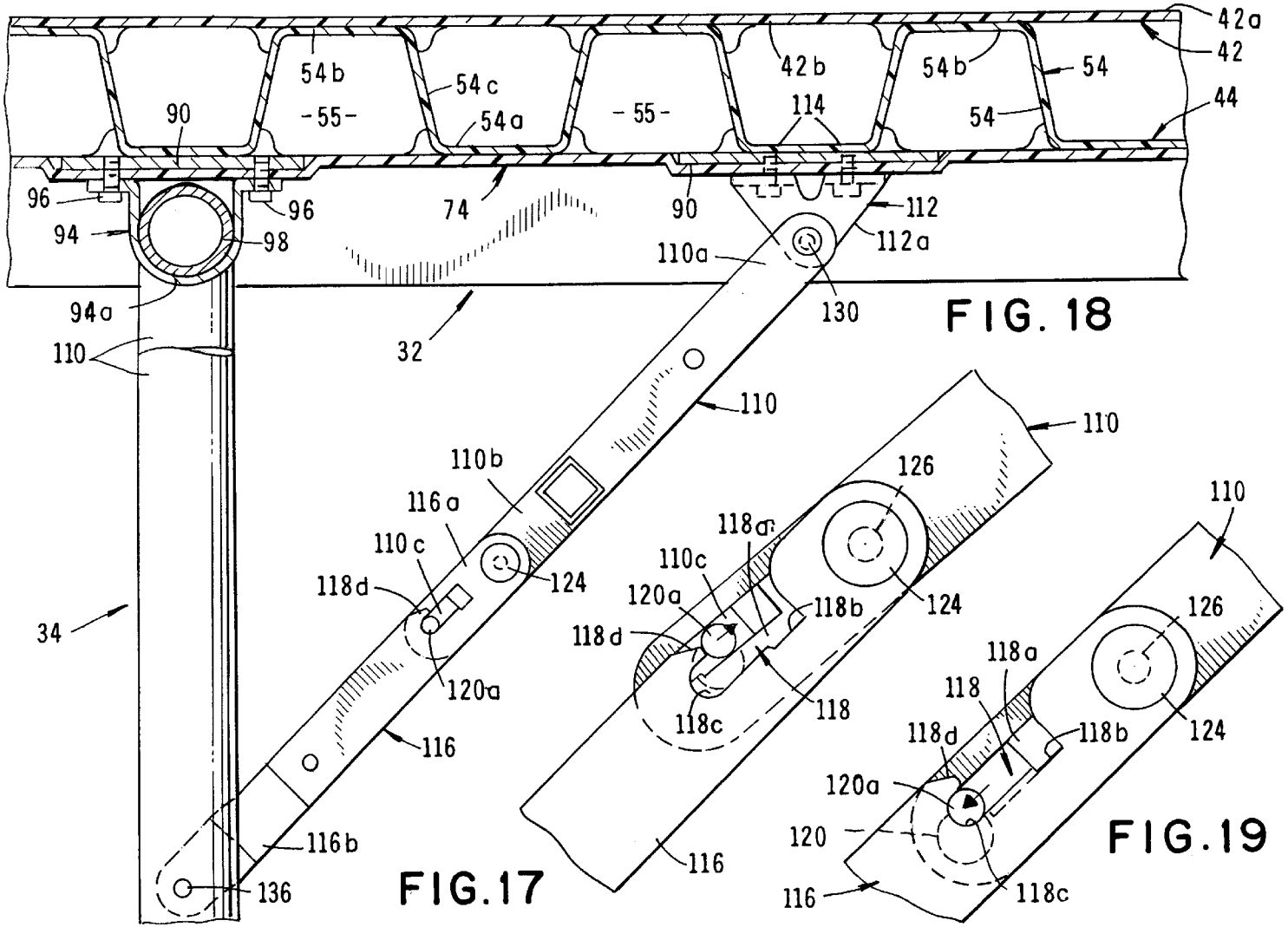
FIG. 17 is a fragmentary, side-elevational view similar to FIG. 16, but showing further movement of the folding leg mechanism toward the locking configuration.
FIG. 18 is a side-elevational view similar to FIG. 15 showing the folding leg mechanism in a fully extended, locked configuration.
FIG. 19 is an enlarged, fragmentary view of the locking portion of the folding leg mechanism shown in a fully extended, locked configuration.

Referring particularly to FIGS. 14 through 20, the mode of operation of the folding leg mechanism of the present form of the invention is there illustrated. As indicated by the phantom lines in FIG. 15, when links 110 and 116 are in an angular relationship, the legs of the table can be moved progressively from the stowed configuration shown in FIG. 14 to an intermediate position shown by the solid lines in FIG. 15. During movement of the legs and the concomitant movement of link elements 110 and 116, the ends 120*a* of locking rod 120 are disposed within a guide slot 110*c* formed in link 110. As the table legs are moved toward the vertical position shown in FIG. 18, links 110 and 116 move toward the aligned position shown in FIG. 18. As the links move toward this aligned position, it is to be noted that rod ends 120*a* move toward ramp portion 118*d* of link 116. Continued movement of links 110 and 116 toward the position shown in FIG. 16 will cause the ends 120*a* of rod 120 to move into engagement with ramp 118*d* which tends to lift the rod slightly so that it can ride over ramp 118*d* and move toward a mating engagement with arcuate shaped portion 118*c* of link 116 in the manner shown in FIG. 17. As indicated in FIGS. 17 and 19, when the ends 120*a* of rod 120 clear the end of ramp 118*d*, the rod assembly will fall by force of gravity causing the ends of the rod to fall into mating locking engagement with arcuate portion 118*c* of slot 118 (see also FIG. 18) wherein the table legs are in a substantially vertical orientation and extend substantially perpendicularly from top assembly 32. With ends 120*a* of locking rod 120 lockably positioned within arcuate portion 118*c* of slot 118, folding of links 110 and 116 relative to each other will be positively prevented by locking rod 120.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

We claim:

1. A lightweight, foldable table comprising:

(a) a top assembly comprising:

(i) a support member including a generally planar first surface having a peripheral portion and a spaced-apart second surface;

(ii) a plastic structural reinforcement core connected to said support member, said core having a central portion and a peripheral flange circumscribing said central portions, said central portion being provided with a multiplicity of structural reinforcement members;

(iii) an enclosure panel connected to said peripheral flange of said core, said enclosure panel having a central portion and a channel shaped portion circumscribing said central portion; and (iv) a reinforcement frame received within said channel shaped portion;

(b) at least one leg assembly pivotally connected to said top assembly; and (c) a folding leg mechanism for use in foldably interconnecting said leg assembly with said top assembly comprising:

(i) first and second spaced apart top links, each said top link having first and second ends;

(ii) securement means connected to said first and second top links proximate said first ends thereof for pivotally interconnecting said top links with said top assembly;

(iii) first and second, spaced-apart leg links connected to said leg assembly, said first and second leg links also being pivotally interconnected with said first and second top links respectively, each said leg link having first and second ends and a rod receiving slot formed therein intermediate said first and second ends, each said rod receiving slot having first and second ends and comprising:

a. a ramp portion disposed proximate one of said first and second ends; and b. a rod retaining portion disposed proximate the other of said first and second ends; and (iv) a rod assembly connected to said top links proximate said second ends thereof, said rod assembly including an elongated rod having end portions slidably receivable within said rod receiving slots of said leg links.

2. The lightweight folding table as defined in claim 1 in which said reinforcement members comprise a multiplicity of upstanding protuberances.

3. The lightweight folding table as defined in claim 1 in which said reinforcement frame comprises a plurality of elongated reinforcement beams each being generally rectangular in cross section.

4. The lightweight folding table as defined in claim 1 in which said folding leg mechanism further includes connector means connected to said leg links for pivotally interconnecting said leg links with said leg assembly.

5. The lightweight folding table as defined in claim 4 in which each of said top links is provided with a guide slot for slidably receiving said end portions of said elongated rod.

6. The lightweight folding table as defined in claim 4 in which each said rod receiving slot comprises:

(a) a shoulder portion; and (b) a guide channel extending between said ramp portion and said shoulder portion, said guide channel terminating at one end in said rod retaining portion.

7. A lightweight foldable table comprising:

(a) a top assembly including:

(i) a support member having a generally planar first surface having a generally rectangular shaped peripheral portion and a spaced-apart second surface;

(ii) a plastic structural reinforcement core connected to said support member, said core having a generally rectangular shaped central portion and a peripheral flange circumscribing said central portion, said central portion being provided with a multiplicity of upstanding protuberances;

(iii) an enclosure panel connected to said peripheral flange of said core, said enclosure panel having a generally rectangular shaped central portion and a channel shaped portion circumscribing said central portion; and (iv) a reinforcement frame disposed within said channel shaped portion between said core and said enclosure panel, said reinforcement frame comprising a pair of longitudinally extending beams which are generally rectangular in cross section and a pair of transversely extending beams connected thereto;

(b) a pair of spaced apart leg assemblies pivotally connected to said top assembly; and (c) a folding leg mechanism for use in foldably interconnecting said leg assemblies with said top assembly, said mechanism comprising:

(i) first and second spaced apart top links, each said top link including first and second ends and having a guide slot formed therein intermediate said first and second ends;

(ii) a linkage plate pivotally connected to said first and second top links proximate said first ends thereof, said linkage plate being interconnectable with said top assembly;

(iii) first and second, spaced apart leg links connected to each of said leg assemblies, said first and second leg links also being pivotally interconnected with said first and second top links respectively, each said leg link having first and second ends and a rod receiving slot formed therein intermediate said first and second ends, each said rod receiving slot having first and second ends and comprising:

a. a ramp portion disposed proximate one end of said rod receiving slot; and b. a rod retaining portion disposed proximate the other end of said rod receiving slot; and (d) a rod assembly spanning said top links proximate said second ends thereof, said rod assembly including an elongated rod having end portions slidably receivable within said guide slot of said top links and also being receivable within said rod receiving slot of said leg links.

8. The lightweight folding table as defined in claim 7 in which each said rod receiving slot formed in said leg links of said folding leg mechanisms comprises:

(a) a shoulder portion disposed proximate one end of said rod receiving slot; and (b) a guide channel extending between said ramp portion and said shoulder portion, said guide channel terminating at one end in said rod retaining portion.

9. The lightweight folding table as defined in claim 8 in which said rod retaining portion of said slot formed in said leg links is generally semicircular in shape.

10. The lightweight folding table as defined in claim 8 in which said beams of said reinforcing frame have a height approximately twice the height of said upstanding protuberances.

11. A table comprising:

(a) a top assembly including a support member, a reinforcement core connected to said support member, enclosure panel connected to said core, and a reinforcement frame disposed between said support member and said enclosure panel;

(b) a pair of leg assemblies pivotally connected to said top assembly for movement between an operable position and a stowed position; and (c) a folding leg mechanism interconnecting said leg assemblies with said top assembly, said mechanism comprising:

(i) first and second spaced apart top links, each said top link including first and second ends and having a guide slot formed therein intermediate said first and second ends;

(ii) securement means connected to said first and second top links proximate said first ends thereof for pivotally interconnecting said top links with said support platform;

(iii) first and second, spaced apart leg links connected to said leg assemblies, said first and second leg links also being pivotally interconnected with said first and second top links respectively, each said leg link having first and second ends and a rod receiving slot formed therein intermediate said first and second ends, each said rod receiving slot having first and second ends and comprising:

a. a ramp portion disposed proximate one end of said rod receiving slot; and b. a rod retaining portion disposed proximate the other end of said rod receiving slot; and (iv) a rod assembly connected to and spanning said top links proximate said second ends thereof, said rod assembly including an elongated rod having end portions receivable within said rod receiving slots formed in said leg links.

12. The table as defined in claim 11 in which each said rod receiving slot comprises:

(a) a shoulder portion disposed proximate said second end of said rod receiving slot; and (b) a guide channel extending between said ramp portion and said shoulder portion of said rod receiving slot, said guide channel terminating at one end in said rod retaining portion.

* * * * *